US005416058A

United States Patent [19]

Uyttendaele et al.

[11] Patent Number: 5,416,058

[45] Date of Patent: May 16, 1995

[54] PROTECTED THERMOSENSITIVE RECORDING MATERIAL

[75] Inventors: Carlo Uyttendaele, Berchem; Herman Uytterhoeven, Bonheiden, both of Belgium

[73] Assignee: Agfa-Gevaert N.V., Mortsel, Belgium

[21] Appl. No.: 206,439

[22] Filed: Mar. 4, 1994

[30] Foreign Application Priority Data

Mar. 8, 1993 [EP] European Pat. Off. ..... 93200652

[51] Int. Cl.[6] ..... B41M 5/40

[52] U.S. Cl. ..... 503/202; 430/531; 503/210; 503/211; 503/226

[58] Field of Search ..... 427/152; 503/202, 210, 503/211, 226; 430/531

[56] References Cited

U.S. PATENT DOCUMENTS 4,431,727 2/1984 Steklenski ..... 430/528

4,962,009 10/1990 Washizu et al. ..... 430/138

*Primary Examiner*—B. Hamilton Hess

*Attorney, Agent, or Firm*—Brumbaugh, Graves, Donohue & Raymond

[57] ABSTRACT

A thermosensitive recording material suited for use in direct thermal imaging by means of an information-wise energized heating element, said recording material containing a thermosensitive recording layer of which the optical density is changed by heat, characterized in that said recording layer is coated with a protective transparent layer essentially consisting of a cellulose nitrate having a substitution degree (DS) in the range of 2.2 to 2.32.

10 Claims, No Drawings

PROTECTED THERMOSENSITIVE RECORDING MATERIAL

DESCRIPTION

1. Field of the Invention

The present invention relates to a recording material suited for use in direct thermal imaging.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.
2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions or incorporated dye is transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reducing agent.

According to U.S. Pat. No. 3,080,254 a typical heat-sensitive copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 in thermal printing image signals are converted into electric pulses and then through a driver circuit selectively transferred to a thermal printhead. The thermal printhead consists of microscopic heat resistor elements, which convert the electrical energy into heat via the Joule effect. The electric pulses thus converted into thermal signals manifest themselves as heat transferred to the surface of the thermal paper wherein the chemical reaction resulting in colour development takes place.

In the past several recording materials were developed for direct thermal imaging, e.g. heat-sensitive copying papers including a recording layer having a substantially light-insensitive organic silver salt and organic reducing agent in a thermoplastic binder such as polyvinyl acetate and polyvinyl butyral (ref. Re 30,107 being reissue of U.S. Pat. No. 3,996,397). Such recording materials are less suited for use in thermographic recording operating with thermal printheads since these recording layers may stick thereto. Moreover, organic ingredients of the thermosensitive recording layer may exude by heat and may soil the thermal printhead at an operating temperature in the range of 300° to 400° C. which are temperatures common in using thermal printheads (ref. the above mentioned book "Handbook of Imaging Materials", p. 502). The undesirable transfer of said ingredients may be promoted by the pressure contact of the thermal printhead with the recording material. Pressures may be 200–500 g/cm$^2$ to ensure a good transfer of heating. The heating time per picture element (pixel) may be less than 1.0 ms.

3. Objects and Summary of the Invention

It is an object of the present invention to provide a thermosensitive recording material suited for use in direct thermal imaging, wherein the thermosensitive imaging layer of said material is effectively protected without substantial loss in imaging properties such as sensitivity and image resolution.

It is a particular object of the present invention to provide a thermosensitive recording material suited for use in direct thermal imaging, wherein the thermosensitive imaging layer of said material is coated with a protective layer that when contacted with an imagewise energized heating element does not stick thereto and prevents soiling of the heating element.

Other objects and advantages of the present invention will appear from the further description.

According to the present invention a thermosensitive recording material suited for use in direct thermal imaging by means of an information-wise energized heating element is provided, which recording material comprises on the same side of a support, called the heat-sensitive side, one or more layers containing in thermal working relationship one or more substances yielding an optical density change by heat, characterized in that one of said layers is coated with a protective transparent resin layer essentially consisting of a cellulose nitrate having a substitution degree (DS) in the range of 2.2 to 2.32 which corresponds with a nitrogen content of 11.8 to 12.2% by weight.

The present invention includes also the use of said recording material in a direct thermal imaging method wherein said method comprises the step of heating the thermosensitive recording layer of said thermosensitive recording material via said protective layer.

By "thermal working relationship" is meant here that said substances may be present in a same layer or different layers wherefrom by heat they can come into reactive contact with each other, e.g. by diffusion or mixing in the melt.

The layer in which the optical density change takes place is called the recording layer.

4. Detailed Description of the Invention

The cellulose nitrate for forming a protective layer according to the present invention may be applied from methanol, ethanol, ethyl, butyl and amyl acetates, acetone and methyl ethyl ketone or mixtures thereof. The cellulose nitrate coating is preferably applied from a solution in methanol which is a non-solvent for polyvinyl butyral being a preferred binder for organic reducible silver salts.

The structure of a cellulose nitrate suitable for use as protective surface coating is the following:

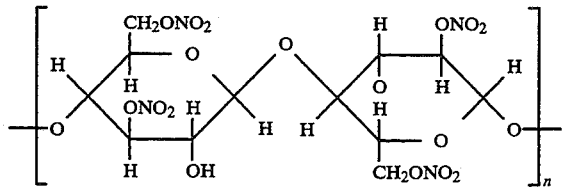

The value of n is related to the viscosity in a given solvent which for a cellulose nitrate preferred for use according to the present invention is at least 50 mPa.s when measured at 20° C. in methanol at a concentration of 7 g/100 ml.

Cellulose nitrate having a value of n in the range of 500 to 600 is used advantageously for the purpose of the present invention and has been described for use as automotive lacquer [ref. The Chemistry of Organic Film Formers by D. H. Solomon—John Wiley & Sons, Inc. New York (1967), p. 151].

Cellulose nitrate may be mixed with polymer(s) providing a mixture having a glass transition temperature (Tg) above that of the applied cellulose nitrate, e.g. is mixed with poly(methacrylates) which are compatible therewith.

The cellulose nitrate protective layer used according to the present invention may contain additives provided such materials do not inhibit its anti-sticking properties and provided that such materials do not scratch, erode, contaminate, or otherwise damage the thermal printing head or harm image quality.

Examples of suitable additives are e.g. plasticizers to improve flexibility. Preferred for that purpose are the simple or polymeric esters of aliphatic or aromatic acids, e.g. of sebacates and adipates. Drying-oil alkyd resins impart greater film strength and resistance to embrittlement. Antioxidants must be added to the drying oil alkyds to prevent cross-linking and partial solubility in the solvents for coating the cellulose nitrate.

The protective layer of the direct thermal recording material according to the present invention may in addition to the inorganic silicate particles comprise or is coated with minor amounts of such other agents like liquid lubricants.

Examples of suitable lubricating materials are surface active agents with or without a polymeric binder. A surface active agent is an amphiphilic molecule containing an apolar group in conjunction with (a) polar group(s) such as carboxylate, sulfonate, phosphates, aliphatic amine salt, aliphatic quaternary ammonium salt groups, polyoxyethylene alkyl ethers, polyethylene glycol fatty acid esters, and fluoroalkyl $C_2$–$C_{20}$ aliphatic acids. Examples of liquid lubricants include silicone oils, synthetic oils, saturated hydrocarbons and glycols.

Siloxane compounds may be applied as a topcoat on the protective layer, preferably are coated in the form of a solution in a non-solvent for the cellulose nitrate e.g. from isopropanol or a $C_6$–$C_{11}$ alkane.

The protective layer has preferably a thickness of about 0.1 to 3 μm, more preferably of 0.3 to 1.5 μm and may be coated on the thermosensitive recording layer by a coating technique known as a gravure printing.

Optionally the protective layer according to the present invention is coated with an outermost slipping layer (i.e. anti-sticking layer) compositions of which are described in e.g. EP 138483, EP 227090, U.S. Pat. Nos. 4,567,113, 4,572,860 and 4,717,711 and in published European patent application 311841.

In an example a suitable slipping layer comprises as binder a styrene-acrylonitrile copolymer or a styrene-acrylonitrile-butadiene copolymer or a mixture hereof and as lubricant in an amount of 0.1 to 10% by weight of the binder(s) a polysiloxane-polyether copolymer or polytetrafluoroethylene or a mixture hereof.

Another suitable slipping layer may be obtained by coating a solution of at least one silicon compound and a substance capable of forming during the coating procedure a polymer having an inorganic backbone which is an oxide of a group IVa or IVb element as described in published European patent application 0554576.

Other suitable slipping coatings are described e.g. in published European patent applications (EP-A) 0 501 072 and 0 492 411.

A slipping layer may have a thickness of about 0.2 to 5.0 μm, preferably in the range of 0.4 to 2.0 μm.

The thermographic recording material for direct thermal recording having a recording layer protected with said cellulose nitrate-containing layer as described herein may be of any type known in the art.

For obtaining optical densities above 2 preferably recording materials comprising a thermosensitive recording layer containing substantially light-insensitive organic silver salts in admixture with a reducing agent therefor in a water-insoluble resin binder are used.

The reducing agent present may be of the type used in known thermographic recording materials for producing a silver image by thermally initiated reduction of substantially light-insensitive silver salts such as silver behenate. Examples of such reducing agents are described in U.S. Pat. No. 3,887,378 and prior art mentioned therein and also in Re. 30,107 being reissue of U.S. Pat. No. 3,996,397.

Sterically hindered phenols or bis-phenols (ref. U.S. Pat. No. 3,547,648) may be used as auxiliary reducing agents that become on heating reactive partners in the reduction of a light-insensitive silver salt such as silver behenate.

Substantially light-insensitive organic silver salts particularly suited for use in direct thermal recording materials according to the present invention are silver salts of aliphatic carboxylic acids known as fatty acids, wherein the aliphatic carbon chain has at least 12 C-atoms, e.g. silver palmitate, silver stearate and silver behenate, but modified aliphatic carboxylic acids with thioether group as described e.g. in GB-P 1,111,492 may be used likewise to produce a thermally developable silver image.

The silver image density depends on the coverage of the reducing agent(s) and organic silver salt(s) and has to be preferably such that on heating above 100° C. an optical density of at least 3 can be obtained.

Preferably at least 0.10 mole of reducing agent(s) per mole of organic silver salt is used. In particular combinations the fatty acid silver salts are present in combination with the free fatty acids.

The ratio by weight of the resin binder to organic silver salt is e.g. in the range of 0.2 to 6, and the thickness of the recording layer is preferably in the range of 3 to 30 μm, more preferably in the range of 8 to 16 μm.

According to a particular embodiment the thermo-sensitive recording material contains in one layer a substantially light-insensitive silver salt and in another layer in thermal working relationship with said silver salt one or more reducing agents therefor.

A heat-sensitive recording material containing silver behenate and 4-methoxy-1-naphthol as reducing agent in adjacent binder layers is described in Example 1 of U.S. Pat. No. 3,094,417.

In order to obtain a neutral black image tone in the higher densities and neutral grey in the lower densities the recording layer contains in admixture with said organic silver salt and reducing agent(s) a so-called toning agent known from thermography or photo-thermography.

Suitable toning agents are the phthalimides and phthalazinones within the scope of the general formulae described in the already mentioned Re. 30,107. Further reference is made to the toning agents described in U.S. Pat. Nos. 3,074,809, 3,446,648 and 3,844,797. Other useful toning agents are benzoxazine dione compounds, e.g. 3,4-dihydro-2,4-dioxo-1,3,2H-benzoxazine described in U.S. Pat. No. 3,951,660.

In addition to said ingredients the recording layer may contain other additives such as antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting pigments, colloidal silica, and/or optical brightening agents. As binding agent for said ingredients preferably thermoplastic resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, galactomannan, polymers derived from α,β-ethylenically unsaturated compounds such as polyvinyl chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene. A particularly suitable ecologically interesting (halogen-free) binder is polyvinyl butyral.

The above mentioned polymers or mixtures thereof forming the binder in the thermographic recording layer may be used in conjunction with waxes or "heat solvents" also called thermosolvents improving the reaction speed of the redox-reaction at elevated temperature.

By the term "heat solvent" in this invention is meant a non-hydrolyzable organic material which is in solid state in the recording layer at temperatures below 50° C. but becomes a liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

The support for the heat-sensitive recording material is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and may be subbed to improve its adherence to the thereon coated thermo-sensitive recording layer.

The coating of the recording layer composition may proceed by any coating technique known in the art using a solvent or solvent mixture for the coating ingredients. Common coating techniques are described e.g. in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Suitable coating techniques are screen-printing, gravure, forward and reverse roll coating. Screen-printing, spray coating and gravure coating are used as a precision method for applying very thin coatings with more accuracy than can be achieved with other techniques.

The direct thermal recording material according to the present invention is particularly suited for use in electrically energized thermal printhead recording.

During recording the thermal printhead makes contact with the protective coating of the direct thermal recording material. The thermal printhead contains tiny selectively electrically energized resistors that may not be soiled and have to be protected against wear.

A survey of printhead requirements is given in the already mentioned Handbook of Imaging Materials, Chapter 11, p. 510–514. Commercially available thermal printheads are e.g. a Fujitsu Thermal Head (FTP-040 MCS001), a TDK Thermal Head F415 HH7-1089, and a Rohm Thermal Head KE 2008-F3.

The information-wise heating may proceed likewise by means of a resistive ribbon wherein an electrical current is injected through tiny printhead electrodes (styli) into a resistive layer (surface resistivity in the range of 500 to 900 ohms/square) coated at the side opposite said electrodes with a continuous electrode, e.g. in the form of vacuum-deposited aluminium layer. A large ground plate electrode aside said printhead electrodes and in contact with the resistive layer ensures that Joule heating is minimized as the current flows to ground (see the already mentioned book "Progress in Basic Principles of Imaging Systems—Proceedings of the International Congress of Photographic Science K61n (Cologne)", (1986) FIG. 6 on page 622 dealing with an embodiment of resistive ribbon printing technology).

The fact that in using a resistive ribbon heat is generated directly in the resistive ribbon and only the travelling ribbon gets hot (not the printheads) an inherent advantage in printing speed is obtained. In applying the thermal printing head technology the various elements of the thermal printing head get hot and must cool down before the head can print without cross-talk in a next position.

The composition and production of a polycarbonate ribbon for non-impact printing (resistive ribbon) is described e.g. in U.S. Pat. No. 4,103,066.

The image signals for modulating the electrical energy to be converted into thermal energy in said thermal printhead or resistive ribbon is obtained directly e.g. from opto-electronic scanning devices or from an intermediary storage means, e.g. magnetic disc or tape or optical disc storage medium, optionally linked to a digital image work station wherein the image information can be processed to satisfy particular needs.

According to still other thermal recording embodiments the present recording material is used in conjunction with an information-wise modulated laser beam or ultrasonic pixel printer as described e.g. in U.S. Pat. No. 4,908,631.

Direct thermal imaging can be used for both the production of transparencies and reflection type prints having an opaque white light reflecting background.

In the hard copy field recording materials on white opaque base, e.g. paper base are used. Said base and/or a layer between the recording layer may contain white light reflecting pigments.

Black-and-white transparencies are widely used in the medical diagnostic field in inspection techniques operating with a light box.

The following example illustrates the present invention without however limiting it thereto. All mentioned percentages and ratios are by weight unless otherwise indicated.

EXAMPLE

A subbed polyethylene terephthalate support having a thickness of 100 μm was doctor blade-coated so as to obtain thereon after drying the following recording layer including:

| | |
|---|---|
| silver behenate | 5.28 g/m$^2$ |
| polyvinyl butyral | 5.34 g/m$^2$ |
| behenic acid | 0.53 g/m$^2$ |
| reducing agent S as defined hereinafter | 2.0 g/m$^2$ |
| 3,4-dihydro-2,4-dioxo-1,3,2H-benzoxazine | 0.39 g/m$^2$ |

Reducing agent S is a polyhydroxy spiro-bis-indane, viz 3,3,3',3'-tetramethyl-5,6,5',6'-tetrahydroxy-spiro-bis-indane.

After drying said recording layer was dip-coated at a wet coating thickness of 75 g/m$^2$ with the following coating composition for forming an outermost protective layer.

| | |
|---|---|
| methanol | 92.2 g |
| cellulose nitrate (DS: 2.25) | 7 g |

-continued

| | |
|---|---|
| TEGOGLIDE 410 (tradename) lubricant | 0.53 g |

A solution of 7 g of said cellulose nitrate in 100 ml of methanol has a viscosity of 58 mPa.s at 20° C.

The coated layer was dried for 10 minutes at 70° C.

A first sample of the thus obtained recording material was used immediately after said drying in direct thermal recording with thermal printer MITSUBISHI CP100 (tradename); a second sample was used after 3 days conditioning at 57° C. and relative humidity of 34%, and a third sample was used after 7 days conditioning at 45° C. and relative humidity of 70%. During printing the printhead was kept in contact with the protective coating.

The adherence of the protective layer to the thermosensitive layer proved to be excellent for the three samples. Marks (stripes) resulting from sticking to the thermal printhead material surface are practically nil, whereas without said protective layer stripes are clearly visible and thus deteriorating the image.

The optical densities of the protected imaged and non-imaged areas were measured in transmission with densitometer MACBETH TD 904 (tradename) provided with an ortho filter (maximal transmission at about 500 nm). The measured minimum optical density ($D_{min}$) was 0.05 and the maximum optical density ($D_{max}$) was for all three samples above 3.

We claim:

1. A direct thermal imaging thermosensitive recording material comprising
   (a) a support,
   (b) an imaging layer that changes optical density upon heating disposed on one side thereof adjacent said support, wherein said imaging layer comprises in admixture:
      (i) a substantially light-insensitive organic silver salt,
      (ii) a reducing agent for said substantially light-insensitive organic silver salt, and
      (iii) a water-insoluble resin binder, and
   (c) a protective transparent layer disposed on said imaging layer on a side of said imaging layer opposite to said support, said protective layer comprising a cellulose nitrate having 2.2 to 2.32 degrees of substitution.

2. The thermosensitive recording material according to claim 1, wherein said substantially light-insensitive organic silver salt is a silver salt of an aliphatic carboxylic acid that comprises an aliphatic carbon chain, said aliphatic carbon chain comprising at least 12 carbon atoms.

3. A direct thermal imaging thermosensitive recording material comprising
   (a) a support,
   (b) a plurality of imaging layers that change optical density upon heating in contact with one another and disposed on one side of one layer thereof adjacent said support, wherein said imaging layers comprise:
      (i) at least one layer containing a substantially light-insensitive organic silver salt and
      (ii) at least one layer containing a reducing agent for said substantially light-insensitive organic silver salt, wherein said substantially light-insensitive organic silver salt and said reducing agent are present in different layers but reactably contact each other upon heating, and (c) a protective transparent layer disposed on the imaging layer least proximal to said support on the side of said imaging layer opposite to said support, said protective layer comprising a cellulose nitrate having 2.2 to 2.32 degrees of substitution.

4. The thermosensitive recording material according to claim 3, wherein said substantially light-insensitive organic silver salt is a silver salt of an aliphatic carboxylic acid that comprises an aliphatic carbon chain, said aliphatic carbon chain comprising at least 12 carbon atoms.

5. A direct thermal imaging recording process comprising imagewise heating with an information-wise energized heating element the thermosensitive recording material comprising (a) a support, (b) an imaging layer that changes optical density upon heating disposed on one side thereof adjacent said support, wherein said imaging layer comprises in admixture:

(i) a substantially light-insensitive organic silver salt, (ii) a reducing agent for said substantially light-insensitive organic silver salt, and (iii) a water-insoluble resin binder, and (c) a protective transparent layer disposed on said imaging layer on a side of said imaging layer opposite to said support, said protective layer comprising a cellulose nitrate having 2.2 to 2.32 degrees of substitution.

6. The direct thermal imaging recording process according to claim 5, wherein said cellulose nitrate has a viscosity of at least 50 mPa.s when dissolved in methanol at a concentration of 7 g/100 mL at 20° C.

7. A direct thermal imaging recording process comprising imagewise heating with an information-wise energized heating element the thermosensitive recording material comprising (a) a support, (b) a plurality of imaging layers that change optical density upon heating in contact with one another and disposed on one side of one layer thereof adjacent said support, wherein said imaging layers comprise:

(i) at least one layer containing a substantially light-insensitive organic silver salt and (ii) at least one layer containing a reducing agent for said substantially light-insensitive organic silver salt, and wherein said substantially light-insensitive organic silver salt and said reducing agent are present in different layers but reactably contact each other upon heating, and (c) a protective transparent layer disposed on the imaging layer least proximal to said support on the side of said imaging layer opposite to said support, said protective layer comprising a cellulose nitrate having 2.2 to 2.32 degrees of substitution.

8. The direct thermal imaging recording process according to claim 7, wherein said cellulose nitrate has a viscosity of at least 50 mPa.s when dissolved in methanol at a concentration of 7 g/100 mL at 20° C.

9. A direct thermal imaging thermosensitive recording material comprising (a) a support, (b) a plurality of imaging layers that change optical density upon heating in contact with one another and disposed on one side of one layer thereof adjacent said support, wherein said imaging layers comprise in admixture:

(i) a substantially light-insensitive organic silver salt, (ii) a reducing agent for said substantially light-insensitive organic silver salt, and (iii) a water-insoluble resin binder, and (c) a protective transparent layer disposed on the imaging layer least proximal to said support on the side of said imaging layer opposite to said support, said protective layer comprising a cellulose nitrate having 2.2 to 2.32 degrees of substitution.

10. The thermosensitive recording material according to claim 9, wherein said substantially light-insensitive organic silver salt is a silver salt of an aliphatic carboxylic acid that comprises an aliphatic carbon chain, said aliphatic carbon chain comprising at least 12 carbon atoms.

* * * * *